United States Patent [19]

Landesman et al.

[11] Patent Number: 4,493,254

[45] Date of Patent: Jan. 15, 1985

[54] SCREEN PRINTING MACHINE AND DRIVE SYSTEM THEREFOR

[75] Inventors: Benjamin J. Landesman; David A. Landesman, both of St. Louis, Mo.

[73] Assignee: Lawson Printing Machines Company, Inc., St. Louis, Mo.

[21] Appl. No.: 546,879

[22] Filed: Oct. 31, 1983

[51] Int. Cl.[3] ..... B41F 15/36; B41F 15/10

[52] U.S. Cl. ..... 101/123; 101/115; 101/126

[58] Field of Search ..... 101/115, 126, 123, 114, 101/129, 407 BP

[56] References Cited

U.S. PATENT DOCUMENTS

| | | | |
|---|---|---|---|
| 1,776,459 | 9/1930 | Tull et al. | 101/123 |
| 2,894,451 | 7/1959 | Landesman | 101/126 |
| 2,975,705 | 3/1961 | Gilman | 101/123 |
| 3,166,011 | 1/1965 | Landesman | 101/123 |
| 3,427,964 | 2/1969 | Vasilantone | 101/115 |
| 3,859,917 | 1/1975 | Bubley et al. | 101/123 |
| 3,955,501 | 5/1976 | Bubley et al. | 101/123 |
| 4,084,504 | 4/1978 | Fuchs | 101/115 |

*Primary Examiner*—Clifford D. Crowder
*Attorney, Agent, or Firm*—Kalish & Gilster

[57] ABSTRACT

A screen printing machine has a carousel rotatable about a central support and carrying a circular arrangement of work-receiving tables. A framework interconnected with the central support carries corresponding screen printing units. Rotation of the carousel causes the work-receiving tables to come into registry with corresponding printing units for screen printing of work carried by the work-receiving tables. Each such unit includes a squeegee support frame pivotal relative to the framework for movement between raised and lowered positions. A screen frame is carried by the squeegee support frame. A squeegee and a scraper blade are supported by a carriage traveling over the squeegee support frame for reciprocal movement over the stencil frame for screen printing of work pieces carried by a corresponding work-receiving table. A cam carried by the framework includes first and second planar surfaces forming an angle $<180°$ between them. A vertical drive shaft, turned by an electric motor, carries at its lower end a drive roller for rolling alternate engagement of the cam surfaces, there being springs for urging the squeegee frame toward its raised position, from which it is driven to the lowered, printing position by drive roller engagement with the cam surfaces. A crank is carried by the upper end of the drive shaft. A connecting rod interconnects the carriage and crank for causing reciprocating movement of the squeegee and the scraper blade upon rotation of the drive shaft.

15 Claims, 8 Drawing Figures

12
24
28
28'
38
52
52'
64
86
90
92
131
134
138
140
142
144
146
148
150

SCREEN PRINTING MACHINE AND DRIVE SYSTEM THEREFOR

BACKGROUND AND SUMMARY OF THE INVENTION

This invention relates in general to a printing apparatus, and, more particularly, to screen printing machines for silk screen printing of various items, such as shirts and other wearing apparel.

It has previously been known to provide silk screening apparatus which has a plurality of printing positions, including plural work supporting stations for being manually rotated into position below corresponding silk screening apparatus of manually operated nature. However, because of the relatively cumbersome, space-consuming configuration of screen printing machinery, the number of printing stations has been severely limited.

Further, prior art apparatus has not been especially well-adapted for remotely controlled, electrically or other power driven implementation. Thus, for example, in Vasilantone U.S. Pat. No. 3,427,964 four silk screening assemblies of manually operated nature are carried by a central support or column about which is manually rotatable a turntable comprising four work supporting platens which can be positioned under a corresponding silk screening assembly for silk screening of a garment panel.

Landesman U.S. Pat. Nos. 2,894,451 and 3,166,011 disclose screen printing machines of single station type with motor-driven rockable stencil and squeegee frames. But these prior art arrangements are not well suited for compact incorporation into multiple work stations in a circular, carousel-type configuration.

It is an object of the present invention to provide an improved multi-station screen printing machine including a plurality of screen printing units, and where the number of such units, which are grouped in a circular arrangement, is greater than previously proposed, and more closely arranged.

Another object of the present invention is the provision of such a multi-station screen printing machine which is electrically driven, and employs electrically driven screen printing units of improved mechanical character and which are of a compact, space-saving nature, to conserve space.

It is a further object of the present invention to provide such units which are highly durable and reliable in operation, having a marked simplicity and paucity of parts which operate to provide superior screen printing, but which are resistant to breakdown; and which may be economically manufactured.

It is also an object of the present invention to provide such a screen printing machine which is configured for being entirely electrically powered for semi-automatic operation from a remote control position by a single operator.

Further, it is an object of the present invention to provide such a screen printing machine which achieves higher speed screen printing, greater productivity and throughput while achieving superior, high-quality screen printing consistently.

Other objects and details of the invention will be in part apparent and in part pointed out by the following description.

BRIEF DESCRIPTION OF THE DRAWINGS

Corresponding reference characters indicate corresponding part throughout the several views of the drawings.

DESCRIPTION OF THE PREFERRED EMBODIMENT

Figure 1:
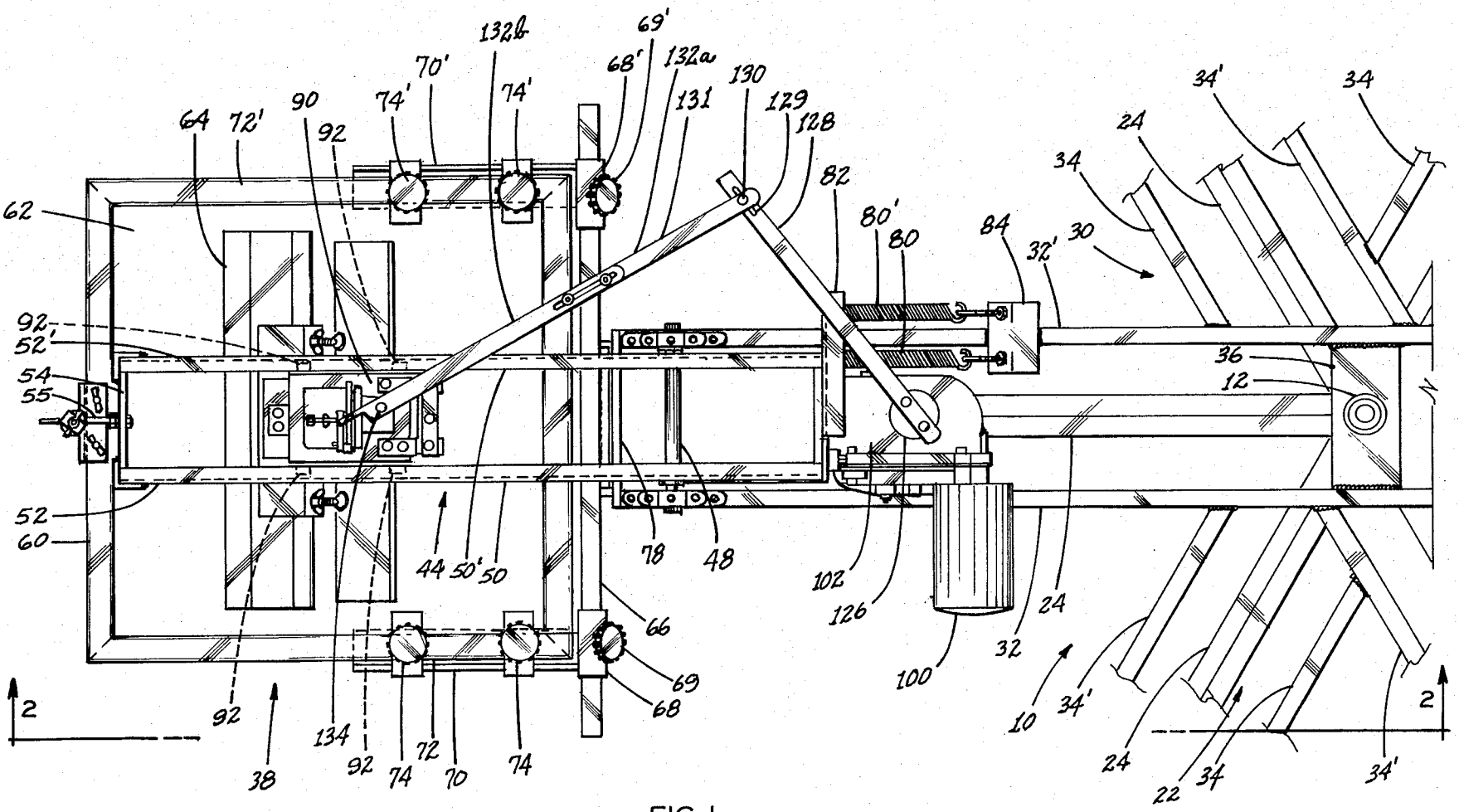
FIG. 1 is a plan view, of fragmentary nature, of a multi-station screen printing machine, and specifically illustrating a screen printing unit thereof, in accordance with and embodying the present invention.

Referring now by reference characters to the drawings, and particularly to FIG. 1, illustrated generally at reference numeral 10 is a screen printing machine of the invention which comprises a central support or post 12 carried by a suitable base 14 including support members as at 16, 17 and including a drive motor 18 for rotation of a hub 20 relative to said base 14. Said drive 18 may be of any of a wide variety of commercially available types, such as including an electric motor, as a prime mover, coupled with speed reducing gearing, or a hydraulic drive, and so forth, the details of the same being beyond the purview of the present invention. Extending laterally from said hub 20 is a carousel generally designated 22, including radial arms, as at 24, having at outer ends respective work-receiving tables 28 (FIG. 8) which are spaced evenly at intervals around a circle with said arms 24 being, thus, configured like the spokes of a wheel.

Figures 6, 7, 8:
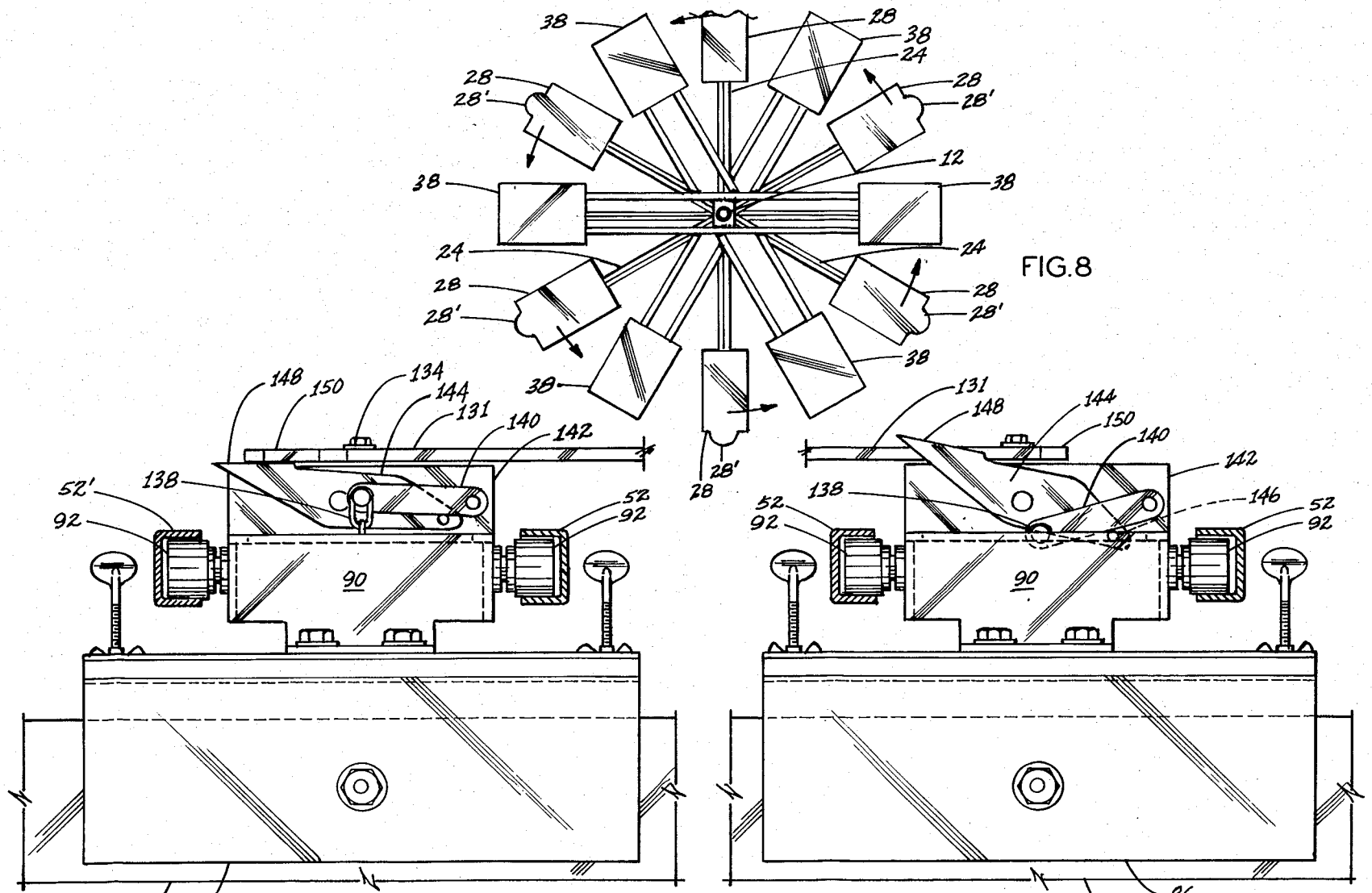
FIG. 6 is a fragmentary transverse cross section taken generally along line 6—6 of FIG. 2.
FIG. 7 is similarly a fragmentary transverse cross section taken generally along line 7—7 of FIG. 3.
FIG. 8 is a simplified plan view of a multistation screen printing machine of the invention.

Also interconnected with said central support 12 is a framework, generally designated 30, comprising a first pair of arms 32, 32' and auxiliary pairs 34, 34' welded to the former, which are interconnected with the central support 12 by a spacer 36, thereby providing altogether six radial extensions from said central support 12 and carrying at their outer extremities screen printing units 38. In FIG. 8, such screen printing units are each shown in schematic, simplified form to illustrate the circular arrangement thereof at equally spaced intervals around said central support 12. According to the preferred embodiment of the invention, there are six such screen printing units 38 and six work-receiving tables 28 in the circular, carousel-like arrangement thus provided thereby to provide six separate work stations of the resultant machine.

Said screen printing units 38, to be described below, are all located in relative position higher than said work-receiving tables 28 whereby, upon rotation of carousel 22, the work-receiving tables 28 will all be caused to rotate below the screen printing units 38 to come individually and successively in registry with corresponding ones of the screen printing units 38 for printing of garments or other work items carried upon said work-receiving tables.

According to one preferred mode of operation, the work-receiving tables 28 are configured, as illustrated, with rounded projections, as at 28', at their outer ends for conformance with the neck of a shirt for being stenciled with a design.

Figure 2:
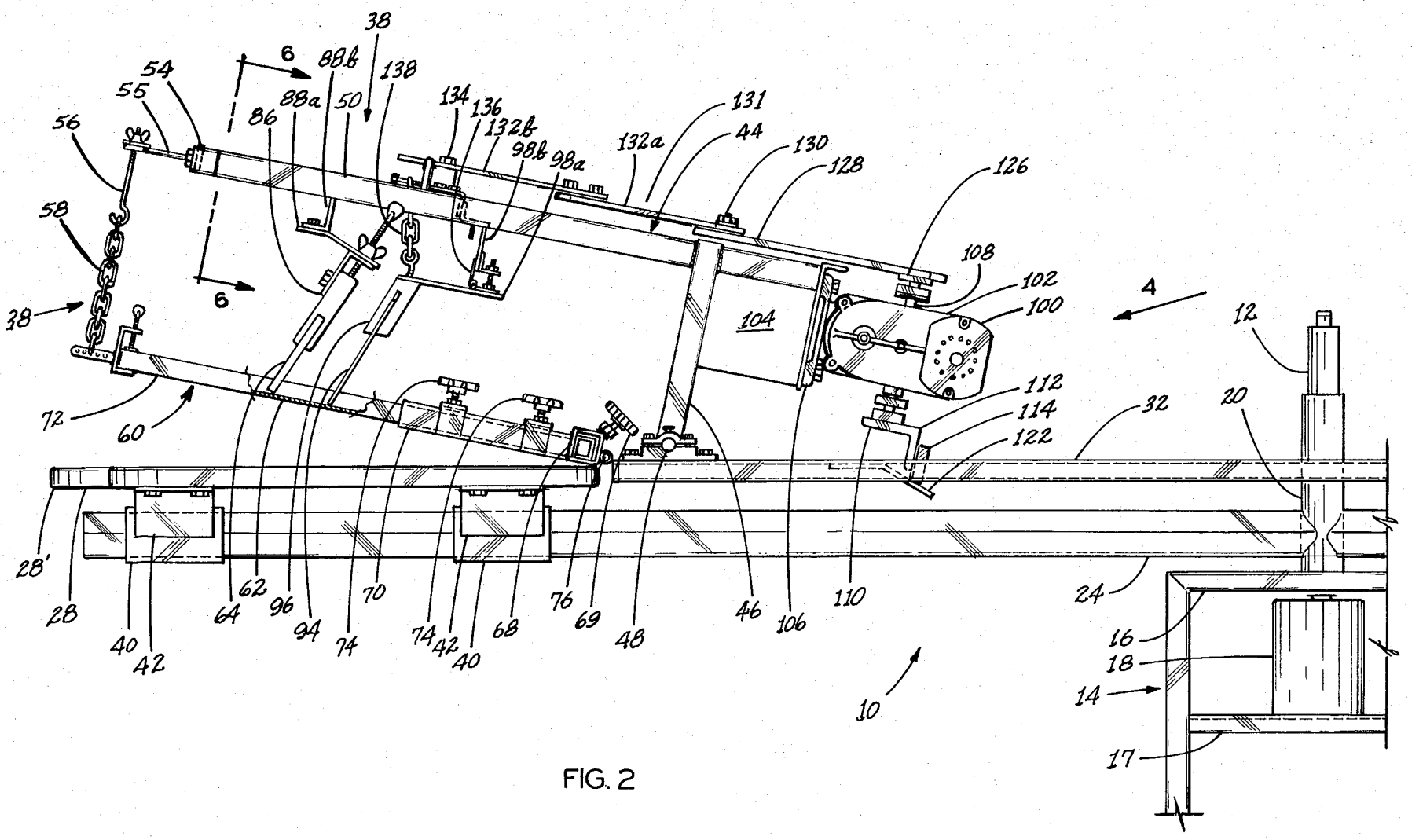
FIG. 2 is a side elevation view thereof; as taken generally along line 2—2 of FIG. 1.

In the apparatus described, the carousel arms 24 are each of rectangular tubular character, the work-receiving tables being of flat, board-like character supported at opposite ends by brackets 40 secured to the respective work-receiving tables 28 by brackets, as at 42 (FIG. 2).

Figure 3:
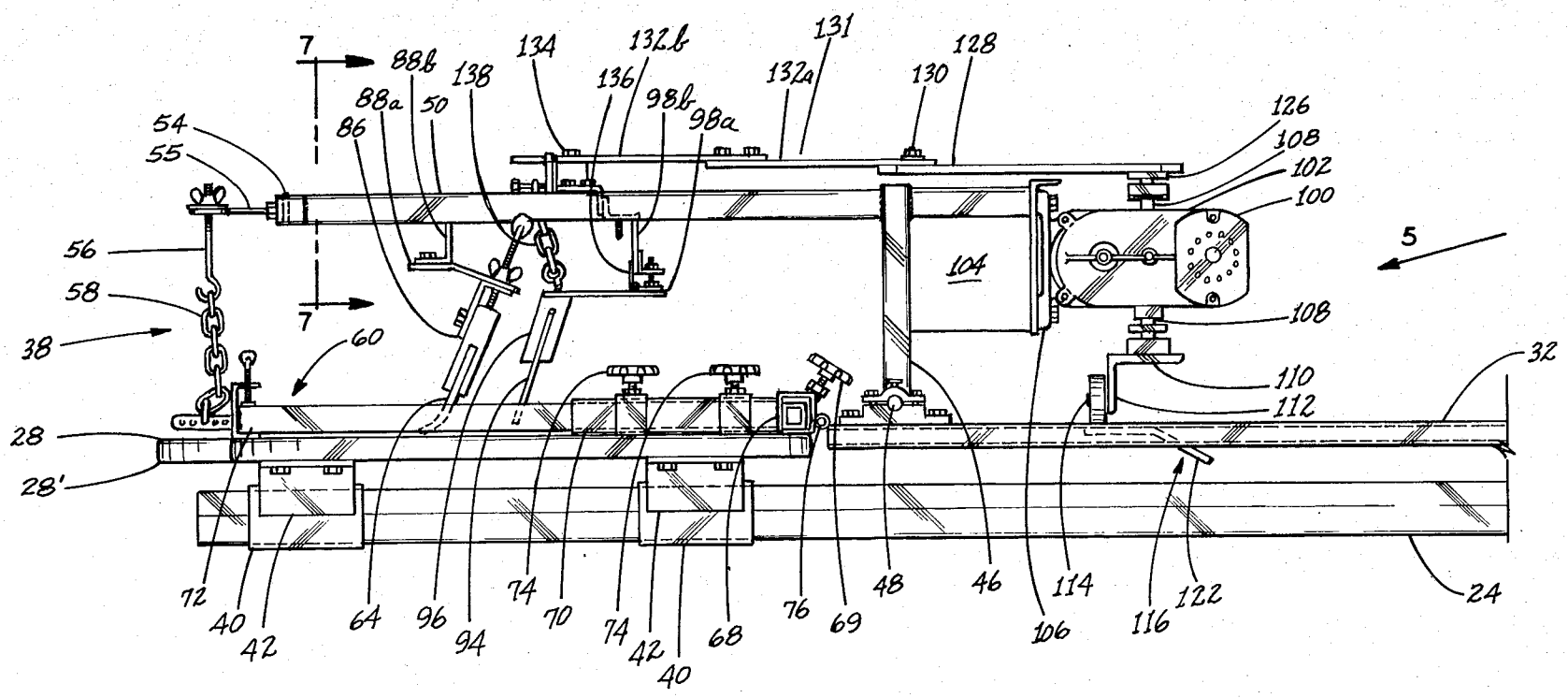
FIG. 3 is a fragmentary side elevation view, similar to FIG. 2, but showing the screen printing unit in a configuration during actual screen printing.
Figure 4:
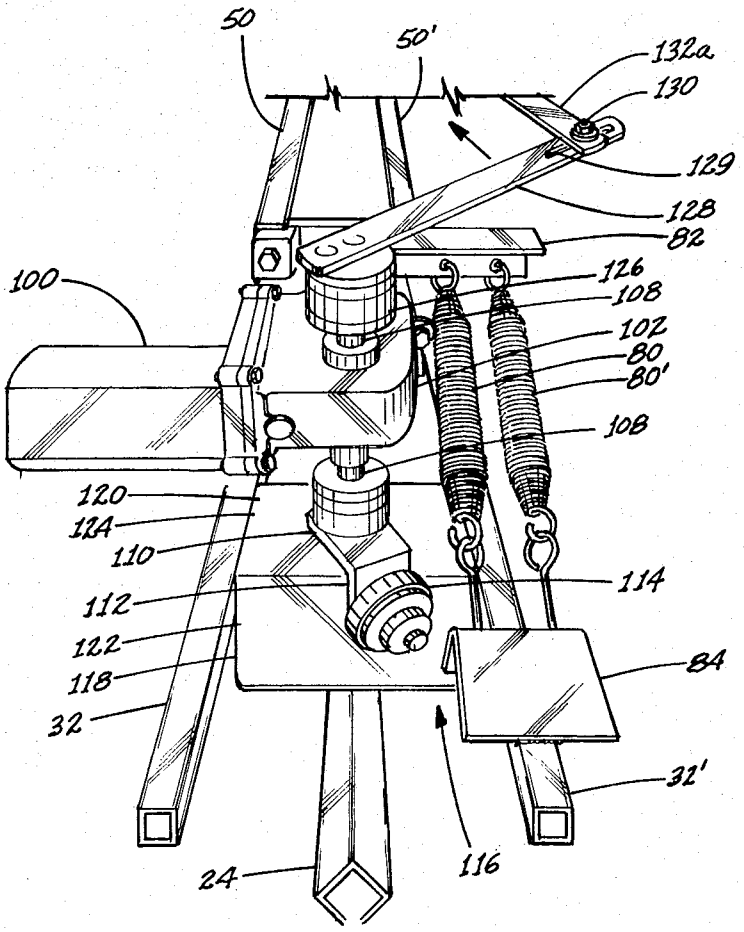
FIG. 4 is a fragmentary perspective view taken generally in the direction of the arrow 4 of FIG. 2.
Figure 5:
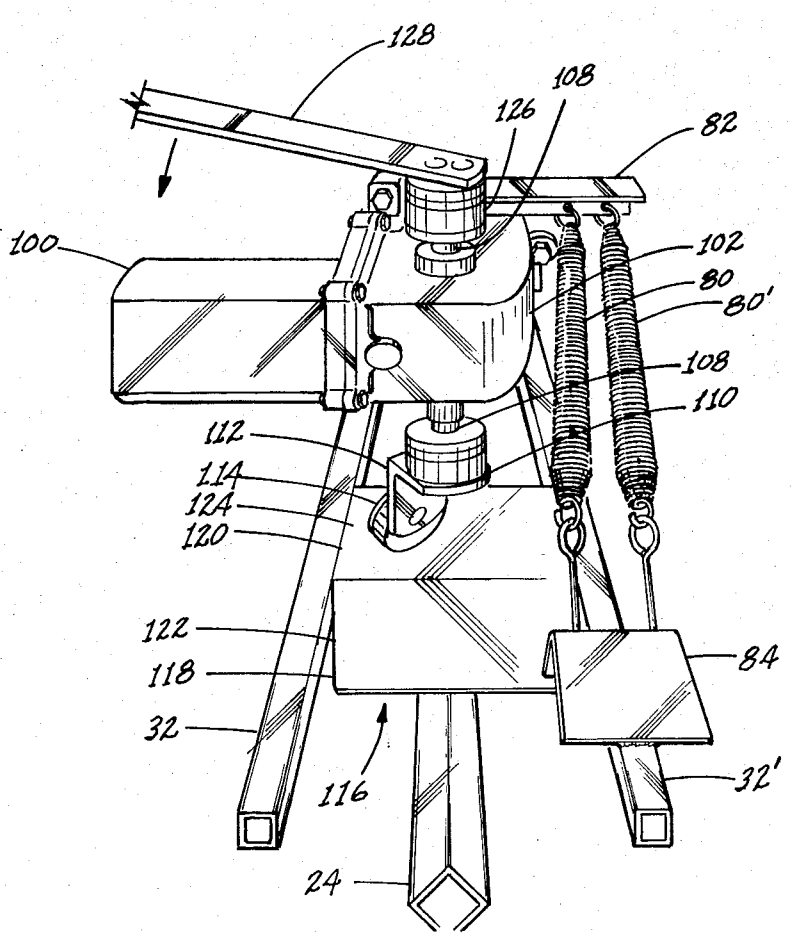
FIG. 5 is a similar perspective view, somewhat more enlarged, taken generally along the arrow designated 5 in FIG. 3, illustrating the position of parts during printing.

Referring generally to FIGS. 1–3, the single screen printing unit there designated generally at 38 comprises a squeegee support frame generally designated 44 having a pair of vertical arms 46 pivoted at their lower end through a shaft 48 extending transversely across outer ends of arms 32, 32' and corresponding pairs of the same for each of the other such screen printing units 38. Extending in spaced, parallel relationship outwardly from arms 46 are corresponding pairs of frame members, as at 50, 50', of U-shaped configuration for defining oppositely oriented channels 52, 52' opening toward one another for purposes presently appearing. At the outer end, said arms 50, 50' are spaced by a brace 54 carrying a eye-bolt 55 which in turn carries a hook screw 56 from which depehds a chain 58 for supporting the distal end of a screen frame generally designated 60. Frame 60 is of rectangular configuration, there being a screen 62 thereacross and adapted to support within frame 60 a quantity of paint or ink, as is well known, adapted to be applied to a predetermined pattern upon said screen 62 by the reciprocating movement of a squeegee 64 supported and driven by an arrangement shortly to be described. At the inner, or proximal end of frame 60, there is provided a transverse bar 66 upon which there are mounted tubular sleeves, 68, 68' at opposite ends thereof adapted to be tightened by tightening screws 69, 69'. Carried by the last-said sleeves are outwardly extending sleeves 70, 70' for receiving corresponding screen frame members 72, 72' and similarly provided with tightening screws, as at 74, 74'. Accordingly, an arrangement is provided for positioning of the screen 60 as desired relative to the work-receiving table 78 when the latter comes into registry.

Member 66 is supported centrally by securement to a hinge, including a hinge-pin 76 (FIG. 2) which is in turn carried by a cross-brace 78, extending across the outer ends of frame members 32, 32'. Thus, screen frame 60 is free to rock upon the axis of shaft of pin 76 and lifted by squeegee frame 44 via chain 58 and with the precise position of frame 60 relative to frame 50 being established by adjustment of screw 56.

By virtue of being journaled upon shaft 48, frame 44 is seen to be movable between an elevated or lifted position, as shown in FIG. 2 and a printing lowered position as seen in FIG. 3. A pair of tensioned coil springs 80, 80' interengage a bracket 82 carried at the inner end of frame 44 and a bracket 84 secured to frame member 32' for resiliently biasing or urging frame 44 to its lifted position as seen in FIG. 2.

Squeegee 64 is carried by a squeegee clamp 86 supported by brackets **88*a*, 88*b* carried by a carriage 90 (FIG. 1) provided with rollers 92 for rolling engagement upon the interior surfaces of frame members 52, 52'. Carriage 90 also carries a scraper blade 94 of width slightly less than squeegee 64 and carried by a clamp 96 supported by brackets 98*a*, 98*b* also interconnected with carriage 90**.

A drive arrangement for driving the carriage, and thereby squeegee 64 and scraper blade 94, includes an electric motor 100 carried by a speed reduction transmission 102 affixed to a support 104, as by a flanged base 106, the support 104 being carried rearwardly of the upright frame members 46. A drive shaft 108 extends in upstanding, vertical relationship from the top and bottom of the gear case of transmission 102 in substantially vertical configuration when the squeegee frame is in its lowered, printing position. Carried upon the lower extension of crank shaft 108 is an L-shaped fixture 110 including a leg 112 carrying a drive roller 114 whereby rotation of shaft 108 will cause rotation of roller 114, which is free to rotate in a substantially vertical plane, as viewed in FIG. 3, for rolling engagement with a cam generally 116 constituted by flat plates 118, 120 welded together to provide corresponding planar surfaces 122, 124 defining between them an angle $<180°$. Drive roller 114, upon rotation of shaft 108, provides rolling alternate engagement of the resultant first and second cam surfaces 122, 124 for causing reciprocal movement of frame 44 between its lower, printing position and the raised position shown in FIG. 2. In this regard, springs 80, 80' resiliently urge squeegee frame 44 toward the raised position of FIG. 2 when drive roller 114 is in the lowest position permitted by its rolling engagement with cam surface 122 by virtue of the radius arm defined by fixture 110; but upon further rotation of shaft 108 (counterclockwise as viewed in FIG. 1) driver roller 114 will be caused to climb the inclined cam surface 122 and comes to roll upon the substantially horizontal cam surface 124. Thus, frame 44 will be driven by the mutual relationship between 114 and cam 116 to its lower, printing position (FIG. 3), remaining in this position throughout the extent of travel of roller 114 upon surface 124. Then, upon roller 114 reaching the end of its travel upon surface 120, it will continue to roll onto inclined surface 122, with springs 80, 80' urging squeegee frame 44 upward, until the fully raised position of FIG. 2 is obtained, whereupon the cycle of movement repeats. As will be apparent, the arcuate extent of rolling engagement of roller 114 upon cam surface 124 defines the period of dwell during which squeegee frame 44 remains in the printing position.

Carried by fitting 126 upon the upper end of drive shaft is a crank constituted by an arm 128 provided with a slot 129 at its outer end carrying a pivot bolt 130, which may be positioned in slot 129 to define the crank radius desired, and by which is pivotally connected a connecting rod 131 constituted by interconnected members **132*a*, 132*b*, whereby the length of rod 131 may be precisely established, the outer end of said rod 131 being connected pivotally to carriage 90 by a pivot bolt 134 whereby, upon rotation of shaft 108, reciprocal movement of carriage 90 relative to frame 44 will be provided. More specifically, carriage 90 is driven outwardly when arm 128 is in the position shown in FIG. 1 produced by counterclockwise rotation of shaft 108 to carry both squeegee 64 and blade 94 outwardly when squeegee frame 44 is raised, Then, when arm 128 crosses the longitudinal centerline of the unit, further rotation of shaft 108 causes carriage 90 to be drawn inwardly in the opposite direction to pull squeegee 64 across the surface of the sheet 62 to provide printing of a work piece upon table 28, such as the panel of a shirt being printed with a design defined by sheet 62**.

As shown in FIG. 3, chain 58 is adjusted to provide a degree of slackness when frame 44 is lowered to the printing position whereby stencil frame 60 first contacts the work surface of table 28 and remains in printing station as squeegee frame 44 continues to the fully lowered position, thereby bringing squeegee 64 into intimate contact with screen surface 62, with the result that drawing of the squeegee across said surface 62 during printing (such movement being to the right in FIG. 3) will cause ink or paint to be squeegeed through screen 62 for printing of the item upon table 28 and with squeegee 64 being flexed as illustrated in FIG. 3. Upon lifting of squeegee frame 44, the slack in chain 58 provides lost motion for permitting squeegee frame 44 to lift squeegee 64 out of engagement with the said screen 62 before screen frame 60 is lifted by rotation upon hinge 76.

Scraper blade 94 is provided for redistribution of the ink or paint upon screen 62 upon the return stroke occuring when frame 44 is elevated, as in FIG. 2 and, for this purpose, it is desired to cause blade 94 to contact screen 62 during movement, as shown in FIG. 2. For this purpose, a linkage is provided for effecting raising and lowering of the scraper blade 94 relative to stencil frame 60 and includes means interconnecting such linkage with connecting rod 131. More specifically, arm **98*a* is pivotally connected by a hinge 136 to member 98*b* and is supported at its outer end by a chain 138 carried at the outer end of an arm 140 (FIG. 7) pivotally connected to a bracket 142 of carriage 90. The position of arm 140 is controlled by a further arm 144 pivoted to bracket 142 and engaging the lower edge of arm 140 by a pin 146 at one end of arm 144. The other end is provided with a cam surface 148 for being engaged by an extension 150 of connecting rod 131, whereby, when carriage 90 is drawn toward central support 12 during printing, surface 148 will be cammed downwardly to the position shown in FIG. 7 to maintain arm 140, and thereby scraper blade 94, in a raised position. Thereby, the scraper blade is out of contact with screen 62 when squeegee 64 is drawn thereacross. Then, when connecting rod 131 crosses the centerline of the unit to cause outward movement of carriage 90, with connecting rod extention 150 occupying the position shown in FIG. 6, scraper blade 94 may contact screen 62, pulling arm 140 down, as permitted by pin 146 of arm 144. At the end of the stroke, said extension 150 engages cam surface 148 to again lift the scraper blade out of engagement with screen. 62. Accordingly, it is seen that an arrangement is provided for redistribution of the stencilling substance upon screen 62 during the return stroke of carriage 90**, but lifting the scraper from such engagement during the printing stroke.

In operation, screen printing machine 10 is utilized for rapid, accurate and efficient screen printing of various possible kinds of work, and being especially well suited, as configured according to the preferred embodiment, for relatively high speed printing of tee-shirts, achieving not only a high degree of accuracy but without sacrificing print quality or speed. Multiple color printing can be effectively carried out with virtually perfect registration.

A single operator may place shirts upon work support tables 28 at a single control location, and the shirts will then, upon rotation of carousel 22, be carried in succession to the screen printing units 28, as shown schematically in FIG. 8, with precise color registration being achieved. Such operator may by suitable foot control or other switch device (not shown) of conventional type cause drive means 18 to rotate until there is registration of work-receiving tables with corresponding printing units 38, as determined by stops or latches of conventional configuration, and with motor 100 of each screen printing unit 38 being energized according to a preferred timing sequence, as controlled remotely by the operator, to cause movement of each squeegee frame 44 to its printing position and corresponding reciprocating movement of carriage 90 for printing by stroking of squeegee 64 and subsequent printing substance redistribution on the return stroke by blade 94.

The arrangement thus provided is very compact and space-efficient requiring, for example, a floor space diameter of only a few feet, as configured for screen printing of tee-shirts. The screen printing units, separately useful according to the present design, as single station units, assure of parallel print stroking relative to shirts or other work on cach work table 28. Motor 100 and the related drive 18 may both be of relatively economical type such as energized by a 115 V.A.C. source of supply readily available in numerous locations, and thereby obviating need for special industrial facilities or wiring.

The reliability and ruggedness of design assures of continued operation under all conditions of usage, while the simplicity of construction and low parts cost provide for economy and ruggedness of design. Yet, the new printing machine and screen printing units provide for ready, facile adjustment to accomodate a variety of printing needs, readily accomodating change in stroke length, change in position of the screen relative to the work, and various thicknesses of the work to be printed.

It is thereby seen that the objects of the present invention are attained and other advantages have been achieved.

Although the foregoing includes a description of the best mode contemplated for carrying out the invention, various modifications are contemplated.

As various modifications could be made in the constructions herein described and illustrated without departing from the scope of the invention, it is intended that all matter contained in the foregoing description or shown in the accompanying drawings shall be interpreted as illustrative rather than limiting.

What is claimed is:

1. In screen printing apparatus for entirely prime mover-driven screen printing of work presented for printing upon a work-receiving table, said apparatus comprising a screen printing unit including a squeegee support frame, a squeegee supported by and movable relative to said squeegee support frame, means presenting said squeegee support frame for pivotal movement in a vertical plane between raised and lowered positions, a screen frame, including a screen, carried by said squeegee support frame for being lowered into a printing position upon said work when said squeegee support frame is lowered, the improvement characterized by drive means including an upstanding drive shaft, a single prime mover for turning said drive shaft, a cam having first and second cam surfaces forming an angle therebetween, cam following means carried at a lower end of said drive shaft for alternately engaging said cam surfaces for causing alternate movement of said squeegee support frame between said raised and lowered positions, a crank at an upper end of said drive shaft swingable around said upstanding drive shaft, and connecting rod means interconnecting said squeegee and crank for reciprocating movement of said squeegee upon rotation of said drive shaft, whereby said single prime mover produces not only cammed raising and lowering of said squeegee support frame but also said squeegee reciprocating movement.

2. In screen printing apparatus according to claim 1, the improvement further characterized by a framework for supporting said squeegee support frame, and means pivotally mounting said squeegee support frame for pivotal movement about a horizontal pivot axis relative to said framework, and means interengaging said framework and squeegee support frame for resiliently urging said squeegee support frame to said raised position, movement of said cam following means upon said first cam surface causing said squeegee support frame to be driven from said raised position to said lowered position and to be maintained in said lowered position while engaging said second cam surface.

3. In screen printing apparatus according to claim 2, the improvement further characterized by said drive means including a speed reducing transmission carried by said squeegee support frame, said drive shaft extending from upper and lower ends of said transmission, and an electric motor, constituting said prime mover, interconnected with said transmission for producing rotation of said drive shaft.

4. In screen printing apparatus according to claim 3, the improvement further characterized by said cam surfaces each being planar and forming between them an angle $<180°$, said cam following means comprising a drive roller for alternate rolling engagement of said planar surfaces.

5. In screen printing apparatus according to claim 4, the improvement further characterized by said cam surfaces being defined by first and second plates carried by said framework, said first plate being angled relative to horizontal, said second plate being substantially horizontal.

6. In screen printing apparatus according to claim 5, the improvement further characterized by said drive roller being carried by a fixture secured to the lower end of said drive shaft for causing said drive roller to be substantially vertical when said squeegee support frame is in a printing position.

7. In screen printing apparatus according to claim 1, the improvement further characterized by a scraper blade also supported and movable relative to said squeegee support frame, and means for raising of said scraper blade relative to said screen frame upon printing movement of said squeegee in one direction, and for lowering said scraper blade relative to said screen frame for redistribution of screening substance upon said screen frame during the opposite direction of movement of said squeegee.

8. In screen printing apparatus according to claim 7, the improvement further characterized by said squeegee and scraper blade being supported by a carriage, said carriage being movable longitudinally along said squeegee support frame, said connecting rod means interengaging said carriage and crank.

9. In screen printing apparatus according to claim 8, the improvement further characterized by said means for raising and lowering said scraper blade comprising a linkage carried by said carriage for establishing raised and lowered positions of said scraper blade and cam means interconnecting said linkage with said connecting rod for alternately raising and lowering said scraper blade in response to reciprocating movement of said connecting rod.

10. In screen printing apparatus according to claim 9, the improvement further characterized by said linkage comprising first member pivoted relative to said carriage for supporting said scraper blade and a second member pivoted relative to said carriage for effecting raising and lowering movement of said first member, said connecting rod having an extension, and a cam surface provided upon said second member for being engaged by said connecting rod extension during printing movement by said squeegee.

11. In screen printing apparatus according to claim 1, the improvement further characterized by means providing lost motion interconnection between said squeegee support frame and said screen frame for causing said squeegee to be brought into contact with a screen carried by said screen frame when said squeegee support frame is lowered, and for causing said squeegee to be out of contact with said screen when said squeegee support frame is raised.

12. In screen printing apparatus according to claim 2, the improvement further charaterized by said apparatus comprising a central support, a carousel rotatable about said central support for carrying a plurality of such work-receiving tables, said framework carrying a corresponding plurality of such screen printing units, said carousel upon rotation bringing said work-receiving tables into registry with said screen printing units for printing of work carried on said tables.

13. A screen printing machine comprising a central support, a carousel rotatable about said central support and defining a plurality of workreceiving tables circularly spaced at even intervals around said carousel, and a framework interconnected with said central support for carrying a corresponding plurality of screen printing units, said carousel upon rotation causing said work-receiving tables to come individually and successively into registry with corresponding ones of said screen printing units for screen printing of work on said tables, each said screen printing unit comprising a squeegee support frame disposed pivotally relative to said framework for swingable movement in a vertical plane between a raised position and a lowered, printing position, a screen frame carried by said squeegee support frame for engaging said work for printing upon lowering of said squeegee support frame, a squeegee carried by said squeegee support frame for reciprocal movement over said screen frame for screen printing of said work, a cam carried by said framework and including first and second planar surfaces forming an angle $<180°$ therebetween, said screen printing unit including a drive motor, a drive shaft turned by said motor for rotation about an upstanding axis, and a drive roller carried by said drive shaft for rolling alternate engagement of said first and second cam surfaces upon rotation of said shaft, means for resiliently urging said squeegee support frame toward said raised position, said cam and drive roller being mutually positioned for permitting said squeegee frame to be so resiliently urged to said raised position when said drive roller engages said first cam surface and for driving said squeegee support frame to said lowered, printing position and for causing said squeegee support to remain in said lowered position while said drive roller engages said second cam surface, a crank carried by said drive shaft, and a connecting rod interconnecting said squeegee with said crank for causing said reciprocating movement of said squeegee upon rotation of said drive shaft.

14. A screen printing machine according to claim 13 and further characterized by a scraper blade also carried by said squeegee support frame and connected also with said connecting rod for reciprocal movement with said squeegee, a linkage for effecting raising and lowering movement of said scraper blade relative to said screen frame, and means interconnecting said linkage with said connecting rod for causing raising of said scraper blade during one direction of reciprocating movement thereof and lowering of said scraper blade during the opposite direction of reciprocating movement thereof for redistribution of screening substance by said scraper when lowered.

15. A screen printing machine according to claim 14 and further characterized by a carriage positioned for longitudinal movement along said squeegee support frame, said carriage supporting said squeegee and said scraper, and carrying said linkage, said connecting rod interengaging said carriage and crank.

* * * * *